US005607545A

United States Patent [19]

Henricson et al.

[11] Patent Number: 5,607,545

[45] Date of Patent: Mar. 4, 1997

[54] OZONE BLEACHING PROCESS UTILIZING A FLUIDIZING MIXER AND SUPER-ATMOSPHERIC PRESSURE

[75] Inventors: Kaj Henricson, Kotka, Finland; Brian Greenwood, Queensbury, N.Y.

[73] Assignee: A. Ahlstrom Corporation, Noormarkku, Finland

[21] Appl. No.: 935,334

[22] Filed: Aug. 27, 1992

Related U.S. Application Data

[63] Continuation of Ser. No. 721,958, Jun. 27, 1991, abandoned.

[51] Int. Cl.[6] ..... D21C 9/14; D21C 9/153; D21C 9/16

[52] U.S. Cl. ..... 162/19; 162/57; 162/65; 162/78; 162/88; 162/90

[58] Field of Search ..... 162/19, 65, 87, 162/88, 89, 57, 78, 90, 241

[56] References Cited

U.S. PATENT DOCUMENTS

| | | | |
|---|---|---|---|
| 4,278,496 | 7/1981 | Fritzvold et al. | 162/65 |
| 4,450,044 | 5/1984 | Fritzvold et al. | 162/65 |
| 4,834,837 | 5/1989 | Loquenz et al. | 162/65 |
| 4,902,381 | 2/1990 | Meredith | 162/65 |
| 5,034,095 | 7/1991 | Kido et al. | 162/65 |
| 5,106,456 | 4/1992 | Voitto et al. | 162/57 |

FOREIGN PATENT DOCUMENTS

| | | | |
|---|---|---|---|
| 397308 | 11/1990 | European Pat. Off. . | |
| 434622A1 | 12/1990 | European Pat. Off. . | |
| 426652 | 5/1991 | European Pat. Off. . | |
| 0426652 | 5/1991 | European Pat. Off. | 162/65 |

*Primary Examiner*—Steven Alvo
*Attorney, Agent, or Firm*—Nixon & Vanderhye P.C.

[57] ABSTRACT

Method and apparatus for ozone bleaching a medium consistency cellulosic fiber suspension include feeding the fiber suspension and an ozone in carrier gas stream under pressure into a fluidizing mixer; intimately and uniformly mixing the fiber suspension with the ozone to achieve a bleaching reaction; passing the mixture into a first reaction vessel to permit the bleaching reaction to proceed and to consume a major part of the ozone; adding a second bleaching chemical to the mixture; separating the excess ozone and carrier gas from the mixture in a second considerably larger vessel and removing the fiber suspension from the second vessel after the effective second bleaching reaction.

19 Claims, 1 Drawing Sheet

OZONE BLEACHING PROCESS UTILIZING A FLUIDIZING MIXER AND SUPER-ATMOSPHERIC PRESSURE

This is a continuation of application Ser. No. 07/721,958, filed Jun. 27, 1991, now abandoned.

FIELD OF THE INVENTION

The present invention relates to ozone bleaching of a medium consistency suspension of cellulosic fibers such as paper pulp and, particularly, to a method of sequentially bleaching pulp by ozone and a second bleaching agent, preferably, an alkali agent to obtain a ZE bleaching sequence.

BACKGROUND OF THE INVENTION

Bleaching of medium consistency paper pulp with ozone has only recently become possible and is described in more detail in pending U.S. applications Ser. No. 693,287 filed Apr. 30, 1991 and Ser. No. 498,205 filed Mar. 23, 1991, the entire content of both of which applications is incorporated herein by reference. Previous draw backs, e.g. the high cost of ozone, the known disadvantages associated with operating at either low consistency (less than about 5%) or at very high consistency (above about 25%) and the fact that ozone readily attacks the carbohydrates of the pulp, have now been overcome. Due to the present invention the efficiency of an ozone bleaching operation of medium consistency pulp, i.e. a cellulosic fiber suspension having a consistency of from about 5 to about 20 percent, is further increased by incorporation of an additional chemical feeding step into the ozone bleaching stage.

SUMMARY OF THE INVENTION

In accordance with the present invention medium consistency pulp, i.e. a cellulosic fiber suspension having a consistency of from about 5–20% is bleached with ozone by (a) feeding said fiber suspension and an ozone containing carrier gas under pressure preferably at about 3 to about 25 bar, more preferably at about 5–14 bar, to a mixer effecting high sheer mixing for intimately and homogeneously intermixing the ozone with the medium consistency fiber suspension. As a carrier gas oxygen, air and nitrogen may be used, with oxygen being presently preferred as it contains the greatest amount of ozone, namely, about 3–16% at the most. Thus, for example, an ozone carrier gas mixture may contain for instance about 10 kg ozone and 90 kg oxygen. At a pulp suspension consistency of 10%, the water/gas ratio is preferably between about 1:10 and 2:1 depending on the pressure which varies between 3 to about 25 bar. (b) In the high shear mixer, which is preferably a commercially available MC© mixer, the ozone in carrier gas and the paper pulp are thoroughly mixed so that an adequate transfer and contact between the ozone and the fibers is achieved resulting in high bleaching efficiency. (c) From the mixers, the intimate and uniform paper pulp/ozone mixture is passed into a first reaction vessel for allowing the bleaching process to proceed until a major part of the ozone is consumed. The residence time of the mixer in the fluidizing mixture is less than 1 second and the residence time of the mixture of paper pulp and ozone in carrier gas in the first reaction vessel is about 0.1 to 5.0 minutes. This permits about 99% of the ozone to be consumed and the bleaching process to be substantially completed. A second chemical agent, preferably a known bleaching agent such as sodium hydroxide, hydrogen peroxide or chlorine dioxide is added to the mixture in liquid form and also intimately mixed therewith. Preferably, the top of the reaction vessel is provided with a known fluidizing device which fluidizes the contents of the reaction vessel for discharging the mixture into a second vessel for permitting the excess ozone, the carrier gas and a minor amount of possible additional reaction gases to separate from the mixture and also to permit the second bleaching reaction to proceed. To this end, this preferably alkaline mixture of paper pulp may reside in the second vessel, which has preferably a considerably larger cross-section than the first reaction vessel, for up to about 1–3 hours. The paper pulp which has now been subjected to a ZE bleaching sequence is then discharged from the bottom of the second vessel either to a washer or to another treatment stage including another bleaching stage in a bleaching sequence. Preferably, the pressure in the first reaction vessel is maintained at a predetermined level by a suitable valve and control loop. The pressure in the second vessel is also controlled with known means, albeit at a lower level relative to the pressure in the first vessel. In addition, a suitable known control device is provided to maintain the level of the paper pulp within the second vessel at least within a predetermined range.

Excess gas may be vented at various locations, such as, for example, from the first reaction vessel through the fluidizing device at the top of the reaction vessel. In this connection it should be kept in mind that a constant pressure should be maintained in the first reaction vessel to achieve maximum ozone bleaching effect. Also, the injection under pressure of the liquid bleaching agent is performed at or in close proximity to the fluidizing operation to intimately and uniformly mix the preferably alkaline bleaching agent with the pulp. Finally, both the first and second vessels are preferably upright reactors, whereby the pulp is passed through the first vessel in an upward direction of flow while the pulp passes through the second vessel in a downward flow.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

The present invention is further described in detail below with reference to the accompanying drawings in which.

DETAILED DESCRIPTION OF THE PRESENTLY PREFERRED EMBODIMENTS

Figure 2:
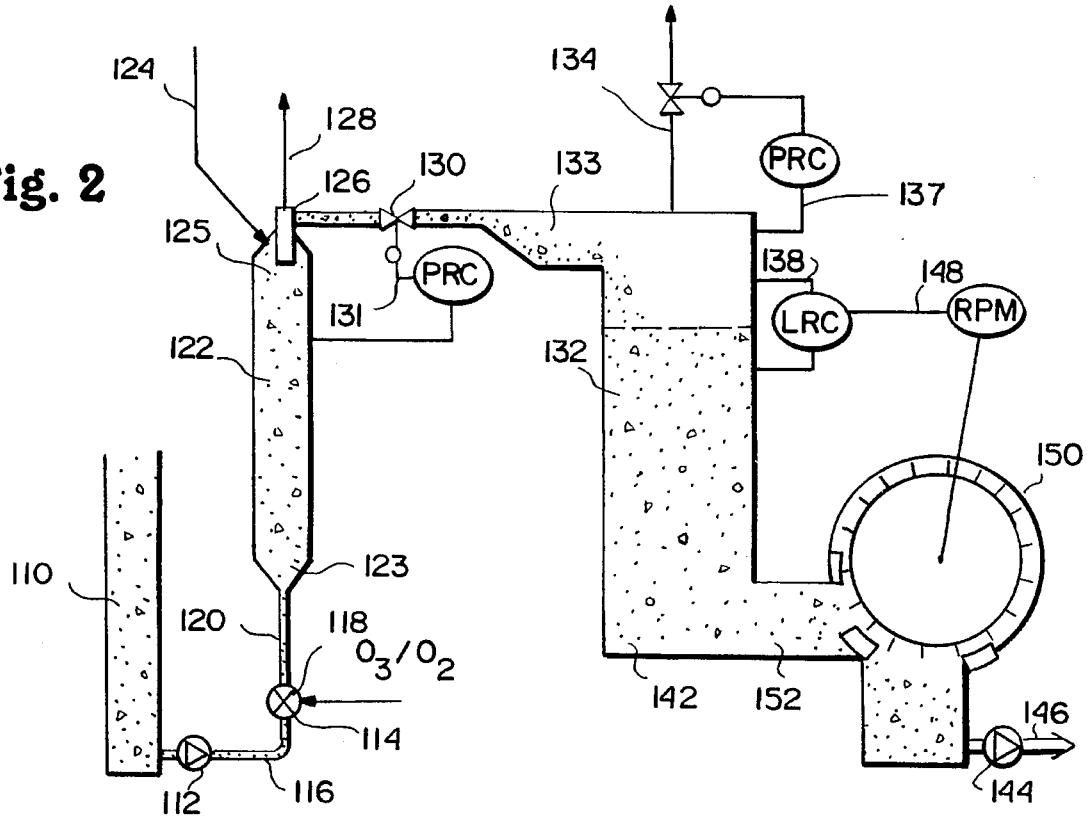
FIG. 2 is a schematic illustration of a second embodiment of the present invention.

In the figures the same elements are given the same numerals with the exception that all numbers in FIG. 2 are preceded by the numeral 1.

Figure 1:
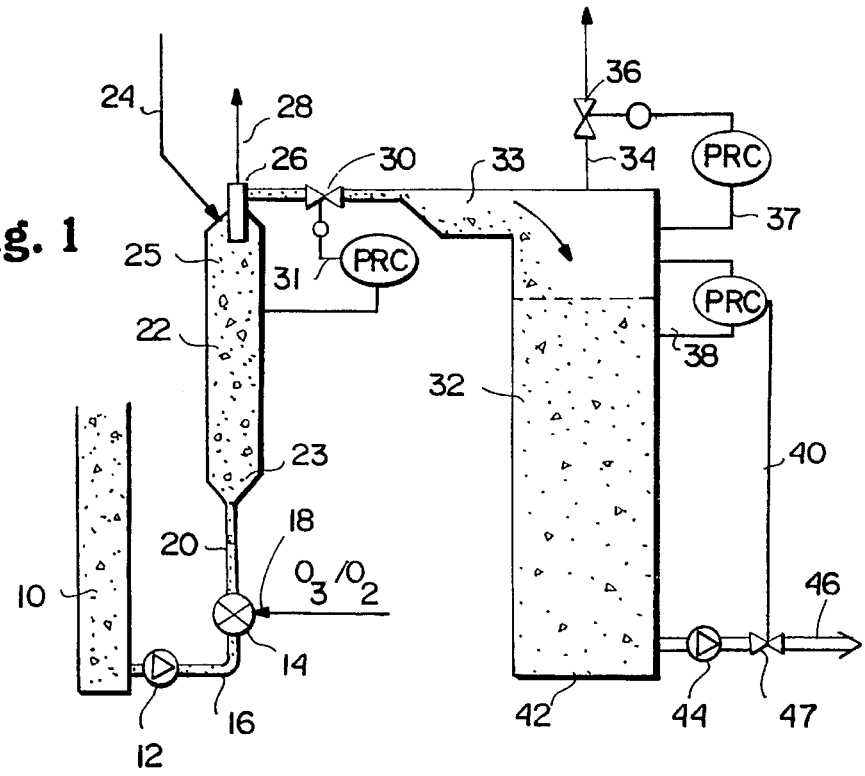
FIG. 1 is a schematic illustration of a first embodiment of the present invention.

Referring now to FIG. 1 in detail, pulp is transferred from a storage unit 10 by a pump 12 which is preferably a degassing medium consistency pump through a line or conduit 16 to a fluidizing mixer 14. Mixer 14 is preferably a high-shear, medium consistency mixer commercially available from Kamyr Inc. of Glens Falls, N.Y. The mixer has an inlet for the medium consistency pulp suspensions connected to line 16, and an inlet port 18, for the pressurized feed of ozone containing carrier gas such as air, nitrogen and preferably oxygen. The pulp suspension is intimately and uniformly mixed with the ozone containing carrier gas and discharged through a mixture outlet into a conduit 20 and passed within about 2–3 seconds into the bottom 23 of a first upright reaction vessel 22. After a residence time of about 0.5 to 5 min. the mixture of pulp, carrier gas and ozone, which has not yet been entirely consumed during the bleaching reaction, arrives at the top 25 of the reaction vessel 22. Into the reaction mixture is now fed through a conduit or line 24, at the top 25 of the reaction vessel 22 an additional bleaching chemical, for example, sodium hydroxide, hydrogen peroxide, sodium peroxide, chlorine dioxide, or the like, preferably in liquid form and if necessary with a carrier, under pressure. Preferably, the bleaching chemical is intimately mixed with the paper pulp to effect the alkaline bleaching step.

To assist the removal of the paper pulp from the first reaction vessel, vessel 22 is provided at the top portion 25 thereof with a known fluidizing device or fluidizing discharger 26 which preferably has an integral injection port for the bleaching chemical at or near the fluidizing rotor or fluidizing device or discharger 26 so as to effect the proper mixing of the bleaching chemical with the fluidized paper pulp. The fluidizing discharger 26 is preferably provided with means 28 for discharging preferably pressurized gas from the reactor to be used, for example, in another pressurized bleaching stage. To achieve good bleaching results and stable conditions the pressure in the first reaction vessel 22 should be maintained at a constant level which is achieved with a pressure regulating valve 27, preferably located closely adjacent fluidizing discharger 26, and control loop 31 in known manner.

The bleached pulp, which now contains excess ozone, carrier gas and bleaching chemical, for example, sodium hydroxide, is now discharged from first vessel 22, preferably into the enlarged inlet portion 33 of a second upright vessel 32 to assist in the separation of the gasses from the pulp mixture. Separated gas is then removed from the second vessel 32 through a gas discharge line 34. The pressure in the second vessel 32 is also maintained steady, albeit at a relatively substantially lower level than in the first vessel, generally only at slight overpressure, by a separate pressure regulating valve 36 and a control loop 37 in a known manner. The pulp is now collected in the second vessel 32 at or near a predetermined level, through known level control means 38, line 41, pump 44, and pressure regulating valve 47 for up to 1 to 3 hours to complete the alkaline (E) bleaching stage and thereafter is discharged at the bottom 42 of vessel 32 by a pump 44, which is preferably also a degassing medium consistency pump, through a valve 47 into a conduit 46 leading to a washer or other suitable treatment stage.

The elements, structure and operation of the embodiment illustrated in FIG. 2 are substantially the same as the embodiment described above in connection with FIG. 1, except that second vessel 132 is provided at its bottom 142 with an outlet 152 which is dimensioned to permit the bleached paper pulp to be fed, due to the pressure head thereof, into a suitable washer 150, preferably a drum diffusion washer as sold by assignee A. Ahlstrom Corporation, with pressurized inlet or diffuser available from Kamyr Inc. of Glens Falls, N.Y.

A level control mechanism 138 cooperates through line 148 with an rpm regulator of washer 150 in known manner to maintain the paper pulp level in the second vessel 132 at a predetermined level. Finally, the washed pulp is discharged from washer 150 by a pump 144, preferably a degassing medium consistency pump through a conduit 146 for further treatment.

It is understood that additions and modifications can be made to the described embodiments which are within the scope of the present invention. The description is thus not to be construed as limiting but only as exemplary, the scope of the invention being properly delineated only in the appended claim.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A method of bleaching medium consistency cellulose pulp with ozone as bleaching agent, utilizing a fluidizing mixer, and first and second reaction vessels, the second vessel larger than the first, comprising the steps of continuously:

(a) feeding medium consistency pulp and ozone gas in substantially non-consumable carrier gas under super-atmospheric pressure into the fluidizing mixer;

(b) intimately mixing the pulp and ozone in the fluidizing mixer to produce a uniform and intimate mixture of pulp and ozone;

(c) while maintaining the mixture under super-atmospheric pressure, feeding the mixture to the first reaction vessel;

(d) retaining the mixture in the first reaction vessel while it moves in a first direction until bleaching with the ozone in the mixture has been substantially completed;

(e) after substantial completion of the ozone bleaching reaction, while super-atmospheric pressure is maintained, introducing a second bleaching chemical, different from ozone, into the pulp in the first reaction vessel;

(f) fluidizing the pulp, with second bleaching chemical, in the first reaction vessel; and (g) discharging the fluidized pulp in a second direction different than the first direction into the second reaction vessel, gas, including ozone carrier gas, separating from the pulp in the second reaction vessel.

2. A method as recited in claim 1 wherein steps (a), (c), and (e) are practiced with the pulp maintained at a pressure of about 3–25 bar.

3. A method as recited in claim 2 wherein the pressure in the second vessel is substantially less than in the first vessel.

4. A method as recited in claim 1 wherein steps (a), (c) and (e) are practiced with the pulp maintained at a pressure of about 5–14 bar.

5. A method as recited in claim 1 wherein step (e) is practiced by introducing a liquid bleaching agent as the second bleaching chemical.

6. A method as recited in claim 5 wherein step (e) is practiced using as the second bleaching chemical a liquid agent selected from the group consisting essentially of sodium hydroxide, hydrogen peroxide, and chlorine dioxide.

7. A method as recited in claim 5 wherein steps (a), (c), and (e) are practiced with the pulp maintained at a pressure of about 3–25 bar.

8. A method as recited in claim 1 comprising the further step of removing the gas that separates from the pulp from the top of the second reaction vessel.

9. A method as recited in claim 1 wherein step (c) is practiced by passing the mixture substantially upwardly, the first direction being substantially vertically upward.

10. A method as recited in claim 9 comprising the further step of passing the pulp substantially vertically downwardly in the second reaction vessel.

11. A method as recited in claim 9 wherein steps (a), (c), and (c) are practiced with the pulp maintained at a pressure of about 3–25 bar.

12. A method as recited in claim 1 comprising the further step of washing the pulp in the second vessel after reaction with the second bleaching chemical in the second reaction vessel takes place.

13. A method as recited in claim 1 wherein step (e) is practiced using sodium hydroxide as the second bleaching chemical.

14. A method of bleaching medium consistency cellulose pulp with ozone as bleaching agent, utilizing a fluidizing mixer, and first and second reaction vessels, the second vessel larger than the first, consisting essentially of the steps of:

(a) feeding medium consistency pulp and ozone gas in substantially non-consumable carrier gas under super-atmospheric pressure into the fluidizing mixer;

(b) intimately mixing the pulp and ozone in the fluidizing mixer to produce a uniform and intimate mixture of pulp and ozone; (c) while maintaining the mixture under super-atmospheric pressure, feeding the mixture to the first reaction vessel;

(d) retaining the mixture in the first reaction vessel while it moves in a first direction until bleaching with the ozone in the mixture has been substantially completed;

(e) after substantial completion of the ozone bleaching reaction, while super-atmospheric pressure is maintained, introducing a second bleaching chemical, different from ozone, into the pulp in the first reaction vessel;

(f) fluidizing the pulp, with second bleaching chemical, in the first reaction vessel;

(g) discharging the fluidized pulp in a second direction different than the first direction into the second reaction vessel, gas, including ozone carrier gas, separating from the pulp in the second reaction vessel; and (h) discharging pulp from the second reaction vessel after the second bleaching chemical has substantially completely reacted with the pulp.

15. A method as recited in claim 14 wherein steps (a), (c), and (e) are practiced with the pulp maintained at a pressure of about 3–25 bar.

16. A method as recited in claim 15 wherein the pressure in the second vessel is substantially less than in the first vessel.

17. A method as recited in claim 14 wherein step (e) is practiced by introducing a liquid bleaching agent as the second bleaching chemical.

18. A method as recited in claim 14 comprising the further step of removing the gas that separates from the pulp from the top of the second reaction vessel.

19. A method as recited in claim 14 wherein step (c) is practiced by passing the mixture substantially upwardly, the first direction being substantially vertically upward, and wherein the pulp moves downwardly in the second vessel.

* * * * *